US009114658B2

(12) United States Patent
Saitou et al.

(10) Patent No.: US 9,114,658 B2
(45) Date of Patent: Aug. 25, 2015

(54) BOOKBINDING SYSTEM

(71) Applicant: RISO KAGAKU CORPORATION, Tokyo (JP)

(72) Inventors: Masahide Saitou, Ibaraki (JP); Kouichi Nobushima, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 21 days.

(21) Appl. No.: 14/185,289

(22) Filed: Feb. 20, 2014

(65) Prior Publication Data

US 2014/0241834 A1 Aug. 28, 2014

(30) Foreign Application Priority Data

Feb. 22, 2013 (JP) ..... 2013-032950

(51) Int. Cl.
*B42C 1/12* (2006.01)
*B31F 5/00* (2006.01)
*B65H 37/04* (2006.01)

(52) U.S. Cl.
CPC . *B42C 1/12* (2013.01); *B31F 5/001* (2013.01); *B65H 37/04* (2013.01); *B65H 2801/27* (2013.01); *G03G 2215/00864* (2013.01)

(58) Field of Classification Search
CPC ..... G03G 2215/00864; B42C 1/12; B65H 37/04; B65H 2801/27; B31F 5/001
USPC ..... 270/58.08, 58.09; 412/11
See application file for complete search history.

(56) References Cited

U.S. PATENT DOCUMENTS 7,963,733 B2 * 6/2011 Marsh ..... 412/37
8,596,637 B2 * 12/2013 Ogawa ..... 271/302
2014/0339754 A1 * 11/2014 Abe et al. ..... 270/1.01

FOREIGN PATENT DOCUMENTS

JP 2006172306 6/2006

* cited by examiner

*Primary Examiner* — Leslie A Nicholson, III
(74) *Attorney, Agent, or Firm* — Greenblum & Bernstein, P.L.C.

(57) ABSTRACT

A bookbinding system includes a printing device which performs printing on text sheets and a cover sheet, a bookbinding device which binds a book by case binding a sheet stack of printed text sheets with a printed cover sheet, and an information processor which outputs bookbinding print data to the printing device. The bookbinding system includes a text sheet retainer which retains one or more types of text sheets, an environmental condition detector which detects environmental conditions in the printing device, a setting unit which sets types and numbers of text sheets, and a sheet stack thickness prediction unit which calculates a prediction value of thickness of a sheet stack including text sheets to be bound, based on the thickness and numbers of sheets of respective types set by the setting unit, according to current environmental conditions detected by the environmental condition detector.

3 Claims, 6 Drawing Sheets

FIG. 3

25

| SHEET TYPE | ENVIRONMENTAL CONDITIONS | | SHEET THICKNESS |
|---|---|---|---|
| | TEMPERATURE | HUMIDITY | |
| ORDINARY PAPER | T1~T2 | H1~H2 | A1 |
| | | H3~H4 | – |
| | | ... | ... |
| | T3~T4 | H1~H2 | B1 |
| | | H3~H4 | – |
| | | ... | ... |
| | ... | ... | ... |
| THIN PAPER | T1~T2 | H1~H2 | C1 |
| | | H3~H4 | – |
| | | ... | ... |
| | T3~T4 | H1~H2 | D1 |
| | | H3~H4 | D2 |
| | | ... | ... |
| | ... | ... | ... |
| THICK PAPER | T1~T2 | H1~H2 | E1 |
| | | H3~H4 | E2 |
| | | ... | ... |
| | T3~T4 | H1~H2 | F1 |
| | | H3~H4 | – |
| | | ... | ... |
| | ... | ... | ... |

BOOKBINDING SYSTEM

BACKGROUND OF THE INVENTION

1. Field of the Invention

The present invention relates to a bookbinding system for manufacturing booklets.

2. Related Background of the Invention

Conventionally, there is known a bookbinding device which manufactures booklets using the case binding function. The case binding function refers to a function of manufacturing a booklet by case binding a sheet stack including text sheets equivalent of a single copy of book with a cover sheet (i.e., binding the booklet by wrapping the sheet stack with the cover sheet).

In addition, there is known a bookbinding system including a bookbinding device as described above, and a printing device which performs printing on the text sheets and the cover sheet, and feeds them to the bookbinding device. With such a bookbinding system, images to be printed on text sheets and cover sheet are edited by a user with a personal computer (PC), and bookbinding print data for printing the edited images is sent from the PC to the printing device.

When editing cover sheet images, an image to be printed on the front cover and an image to be printed on the back cover are positioned by sandwiching the region of the spine. Here, the thickness of the spine corresponds to the thickness of the stack of text sheets. Therefore, the thickness of the spine varies depending on the number of text sheets equivalent of a single copy of book and the type of text sheets.

When, in editing cover sheet images, the thickness of the spine (sheet stack thickness) has been inappropriately set, the booklet to be completed may turn out to be a defective item due to a displacement of a printing position of cover sheet images. In order to prevent occurrence of defective items, an accurate setting of the thickness of the spine is required when editing cover sheet images.

Since the bookbinding device cuts the cover sheet into a size corresponding to the sheet stack when performing a bookbinding operation, the thickness of the stack of text sheets is measured. However, the measurement is not yet performed at the stage of editing the images with the PC, and thus the actual thickness of the sheets is unknown.

In contrast, Patent Literature 1 discloses a technique for obtaining, from a table in which types of paper are associated with paper thickness, the paper thickness corresponding to the type of paper set as text sheets, and predicting the sheet stack thickness based on the paper thickness and the number of the sheet stack.

PRIOR ART DOCUMENT

Patent Literature

Patent Literature 1 Japanese Patent Application Laid-Open Publication No. 2006-172306

SUMMARY OF THE INVENTION

The thickness of sheets varies due to influence of environmental conditions such as temperature or humidity of the place where the sheets are stored. Patent Literature 1 does not take into account such environmental condition, and has not been able to provide a sufficient accurate prediction of the sheet stack thickness.

It is an object of the present invention, which has been made in view of the foregoing, to provide a bookbinding system which can enhance the prediction accuracy of the thickness of the stack of text sheets.

In order to achieve the object described above, a first characteristic of the bookbinding system according to the present invention is a bookbinding system including: a printing device which performs printing on text sheets and a cover sheet; a bookbinding device which binds a book by case binding, with the cover sheet printed by the printing device, of a sheet stack including the text sheets printed by the printing device; and an information processor which outputs a bookbinding print data to the printing device, a text sheet retainer which is provided in the printing device and retains one or more types of the text sheets; an environmental condition detector which is provided in the printing device and detects environmental conditions in the printing device; a setting unit which sets the types of the text sheets to be bound and a number of each of the types of the text sheets; and a sheet stack thickness prediction unit which calculates a prediction value of a sheet stack thickness including the text sheets to be bound, based on a sheet thickness according to the environmental conditions detected by the environmental condition detector, for each of the types of the text sheets set by the setting unit, and the number of the text sheets of each type set by the setting unit.

A second characteristic of the bookbinding system according to the present invention is such that the bookbinding system further includes a sheet thickness table which stores a sheet thickness of each type of the text sheets retained by the text sheet retainer in association with the environmental conditions, and the sheet stack thickness prediction unit obtains, from the sheet thickness table, the sheet thickness according to the environmental conditions detected by the environmental condition detector, for each type of the text sheets set by the setting unit, and calculates a prediction value by using an obtained sheet thickness of each type of the text sheets.

A third characteristic of the bookbinding system according to the present invention further includes a sheet stack thickness measuring unit which is provided in the bookbinding device and measures the sheet stack thickness including the text sheets; a storage unit which stores, as a measurement history information, the sheet stack thickness measured by the sheet stack thickness measuring unit during bookbinding operation, in association with the number of each type of the text sheets in each of the sheet stacks and the environmental conditions at a time of measurement; and a sheet thickness calculation unit which calculates, by using the measurement history information, the sheet thickness which is not yet stored in the sheet thickness table as the sheet thickness corresponding to the environmental conditions and the types of the text sheets, and which adds the calculated sheet thickness to the sheet thickness table.

BRIEF DESCRIPTION OF THE DRAWINGS

FIG. 3 illustrates a sheet thickness table.

DESCRIPTION OF THE PREFERRED EMBODIMENTS

Figure 1:
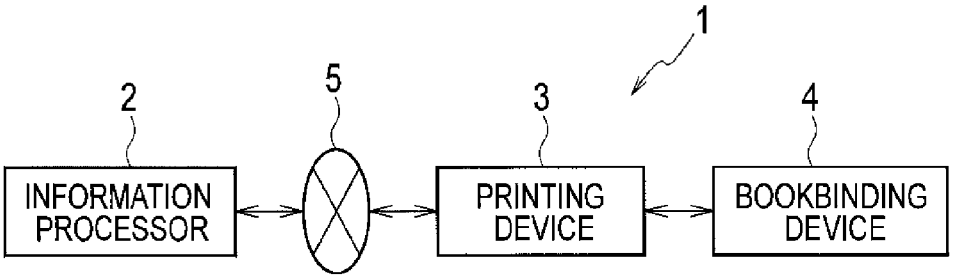
FIG. 1 is a block diagram illustrating a configuration of a bookbinding system according to a first embodiment.

In the following, an embodiment of the present invention will be described, referring to the drawings. Identical or equivalent parts or components are provided with identical or equivalent reference numerals throughout the drawings. However, it should be noted that the drawings are schematic and different from the reality. In addition, it is needless to say that the drawings include parts that are mutually different in dimensions or ratios.

In addition, the embodiment illustrated in the following exemplify devices or the like which implement the technical idea of the invention, and the technical idea of the invention does not limit the arrangement of respective components to those described below. Various modifications can be made to the technical idea of the invention within the scope of the claims.

First Embodiment

Figure 2:
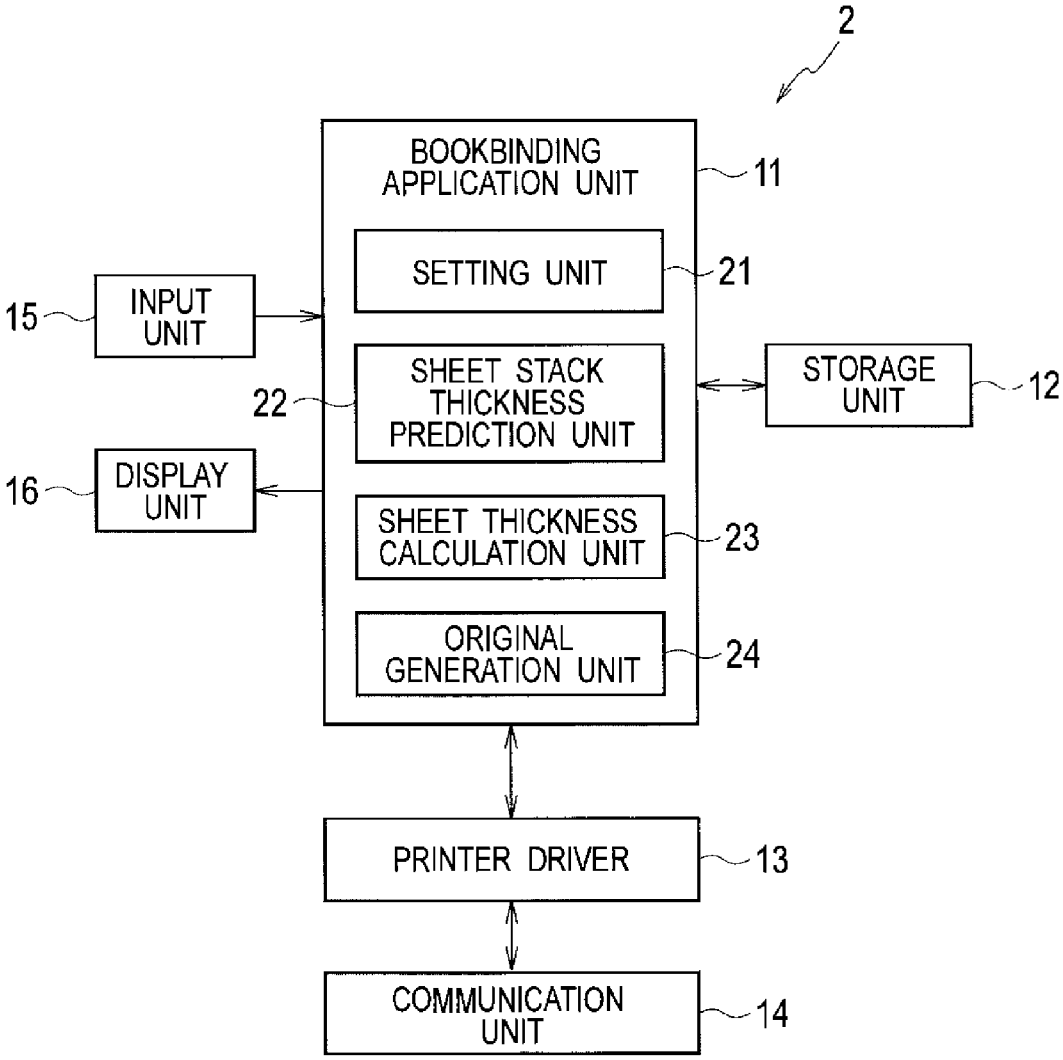
FIG. 2 is a block diagram illustrating a configuration of an information processor in the first embodiment.
Figure 4:
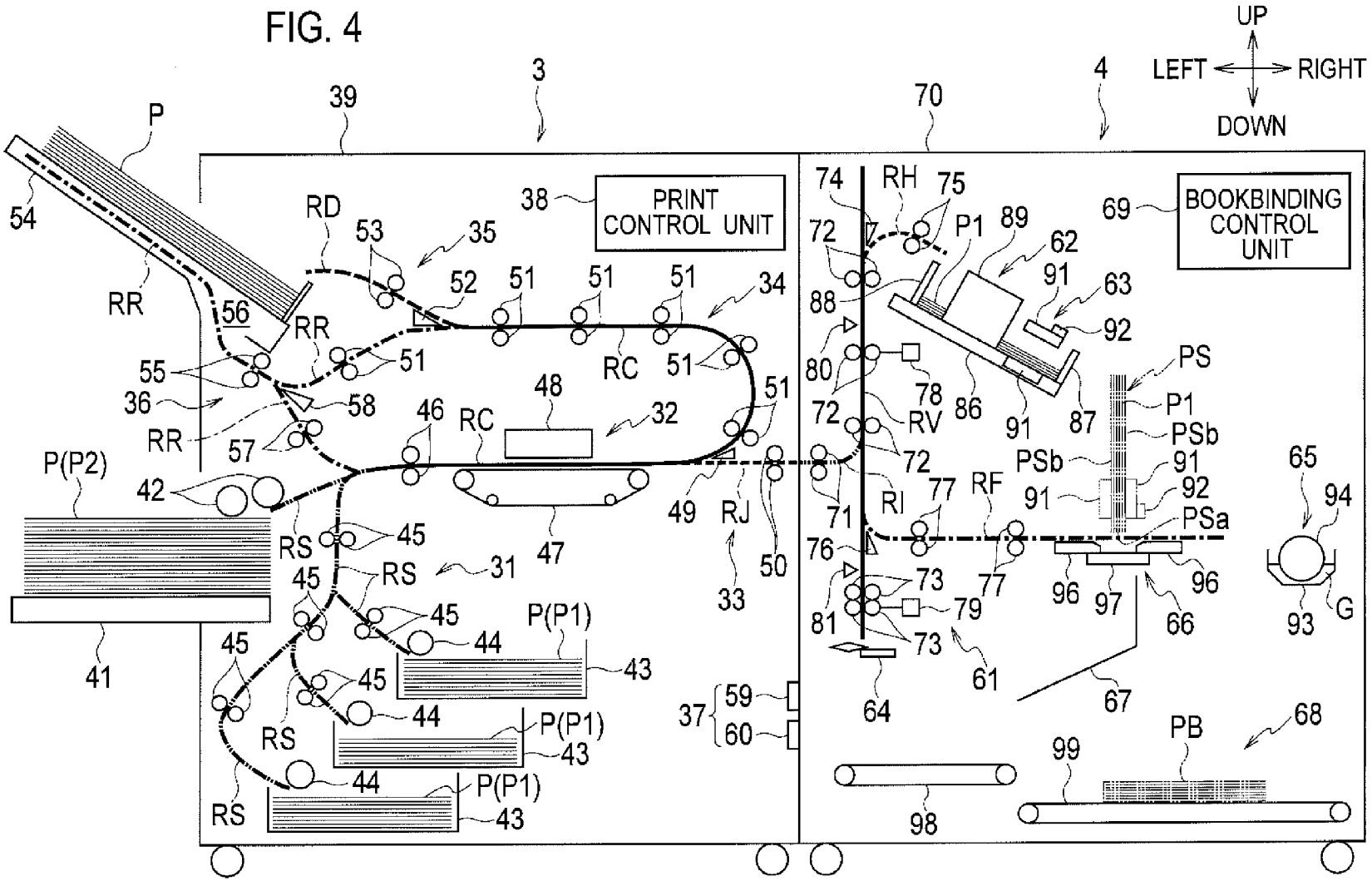
FIG. 4 illustrates an overall configuration of the printing device and the bookbinding device in the first embodiment.

FIG. 1 is a block diagram illustrating a configuration of a bookbinding system according to a first embodiment, FIG. 2 is a block diagram illustrating a configuration of an information processor, FIG. 3 illustrates a sheet thickness table, and FIG. 4 is a schematic configuration diagram of a printing device and a bookbinding device.

As illustrated in FIG. 1, a bookbinding system 1 according to the first embodiment includes an information processor 2, a printing device 3, and a bookbinding device 4.

The information processor 2 outputs, to the printing device 3, bookbinding print data for performing printing on text sheets and cover sheets in bookbinding printing. The information processor 2 is capable of communicating with the printing device 3 via a network 5 such as a LAN. As illustrated in FIG. 2, the information processor 2 includes a bookbinding application unit 11, a storage unit 12, a printer driver 13, a communication unit 14, an input unit 15, and a display unit 16.

The bookbinding application unit 11 generates original data for printing on text sheets and cover sheets when performing bookbinding printing. The bookbinding application unit 11 includes a setting unit 21, a sheet stack thickness prediction unit 22, a sheet thickness calculation unit 23, and an original generation unit 24.

The setting unit 21 receives a setting of bookbinding printing conditions by user operation and sets the bookbinding printing conditions. The bookbinding printing conditions include: types of text sheets to be bound, numbers of text sheets of respective types, thickness of the spine of the cover sheet, or the like.

The sheet stack thickness prediction unit 22 calculates a prediction value of the thickness of the sheet stack including text sheets to be bound. Specifically, the sheet stack thickness prediction unit 22 calculates a prediction value of the thickness of the sheet stack, on the basis of sheet thickness according to current environmental conditions in the printing device 3, for respective types of text sheets set by the setting unit 21, and the set numbers of sheets of respective types. Here, the sheet stack thickness prediction unit 22 obtains, from a sheet thickness table 25 described below, sheet thickness of each type of sheet according to current environmental conditions in the printing device 3.

By using measurement history information of sheet stack thickness described below, the sheet thickness calculation unit 23 calculates sheet thickness which is not yet stored in the sheet thickness table 25 as sheet thickness corresponding to environmental conditions and sheet type, and adds the calculated thickness to the sheet thickness table 25.

The original generation unit 24 generates original data for performing printing on the text sheets and the cover sheet, according to the editing task by the user.

The storage unit 12 has stored therein the sheet thickness table 25 illustrated in FIG. 3. As schematically illustrated in FIG. 3, the sheet thickness table 25 stores, in association with environmental conditions, sheet thickness of each type of text sheet being retained in a paper feeder 31 of the printing device 3. The environmental conditions include temperature and humidity. For example, sheet thickness of ordinary paper is A1 for a temperature between T1 and T2 and a humidity between H1 and H2. In addition, the storage unit 12 stores measurement history information of the thickness of the sheet stack. The measurement history information is information having associated therein the thickness of each sheet stack measured by a sheet stack thickness sensor 92 described below during bookbinding operation with the numbers of sheets of respective types in each of the respective sheet stacks and environmental conditions at the time of measurement.

The printer driver 13 converts the original data generated in the original generation unit 24 into bookbinding print data in a format for transmission to the printing device 3.

The communication unit 14 connects the information processor 2 to the network 5. Accordingly, the information processor 2 has become possible to communicate with the printing device 3.

The input unit 15 receives various input operations by the user.

The display unit 16 displays various screens such as an editing screen for bookbinding printing.

The information processor 2 includes a personal computer having a CPU, a RAM, a ROM, and a storage device such as a hard disk. A function of the bookbinding application unit 11 is implemented by executing, by the CPU, an editing program for bookbinding printing stored in the storage device such as a hard disk. In addition, a function of the printer driver 13 is implemented by executing, by the CPU, a printer driver program stored in the storage device such as a hard disk. The storage unit 12 is implemented by the storage device such as a hard disk. The communication unit 14 is implemented by the communication control unit which connects the information processor 2 to a LAN or the like. The input unit 15 includes a keyboard, a mouse or the like. The display unit 16 is implemented by a Liquid Crystal Display or the like.

A printing device 3 performs printing on sheets P. As illustrated in FIG. 4, the printing device 3 includes a paper feeder 31 (text sheet retainer), a printer 32, an connecting unit 33, a upper surface conveyance unit 34, a paper discharger 35, a reversing unit 36, an environmental condition detector 37, a print control unit 38, and housing 39 for receiving or retaining respective units.

The paths indicated by the bold line in FIG. 4 are conveyance paths along which the sheets P are conveyed. Among the conveyance paths in the printing device 3, the path indicated by the solid line is a normal path RC, the path indicated by the one-dot chain line is a reverse path RR, the path indicated by the long dashed line is an paper discharge path RD, the path indicated by the short dashed line is the connecting path RJ, and the path indicated by the two-dot chain line is a paper feed path RS. The sheets P used for printing are conveyed from upstream to downstream along the conveyance path, where the terms upstream and stream in the following description refer to upstream and downstream of the conveyance path, respectively.

The paper feeder 31 feeds sheets to the printer 32. The paper feeder 31 retains the sheets P for use in bookbinding printing. At the time of bookbinding printing, the paper feeder 31 retains text sheets P1 and a cover sheet P2 for use in bookbinding printing. The paper feeder 31 is arranged on the most upstream side of the conveyance path. The paper feeder 31 includes an external paper feed tray 41, an external paper feed roller 42, a plurality of internal paper feed trays 43, a plurality of internal paper feed rollers 44, and a plurality of pairs of internal paper feed conveyance rollers 45.

The external paper feed tray 41 is provided in order to stack the sheets P for use in printing. The external paper feed tray 41 is installed with a part thereof being exposed outside the housing 39.

The external paper feed roller 42 takes out the sheets P one by one from the external paper feed tray 41, and conveys them toward a resist roller 46 along the paper feed path RS. The external paper feed roller 42 is arranged above the external paper feed tray 41. The external paper feed roller 42 is driven by a motor not illustrated.

The internal paper feed tray 43 is provided in order to stack the sheets P for use in printing. The internal paper feed tray 43 is arranged within the housing 39.

The internal paper feed roller 44 takes out the sheets P one by one from the internal paper feed tray 43, and sends them out to the paper feed path RS. The internal paper feed roller 44 is arranged above the internal paper feed tray 43. The internal paper feed roller 44 is driven by a motor not illustrated.

The internal paper feed conveyance rollers 45 convey the sheets P taken out from the internal paper feed tray 43 toward the resist roller 46. The internal paper feed conveyance rollers 45 are arranged along the paper feed path RS. The internal paper feed conveyance rollers 45 are driven by a motor not illustrated.

The printer 32, while conveying the sheets P, prints an image on the sheets P. The printer 32 is arranged on the downstream side of the paper feeder 31. The printer 32 includes the resist roller 46, a belt conveyance unit 47, and an inkjet head unit 48.

After temporarily stopping the sheets P which have been conveyed from the paper feeder 31 or the reversing unit 36, the resist roller 46 conveys the sheets P toward the belt conveyance unit 47. The resist roller 46 is arranged on the normal path RC in the vicinity of the junction point of the paper feed path RS and the reverse path RR. The resist roller 46 is driven by a motor not illustrated.

The belt conveyance unit 47 retains by suction on a belt and subsequently conveys the sheets P which have been conveyed from the resist roller 46. The belt conveyance unit 47 is arranged on the downstream side of the resist roller 46. The belt conveyance unit 47 is driven by a motor not illustrated.

The inkjet head unit 48 includes a plurality of line-type inkjet heads not illustrated having a plurality of nozzles arranged in a direction substantially perpendicular to the conveyance direction of the sheets P (forward and backward direction, i.e., a direction substantially perpendicular to the vertical direction and the horizontal direction in FIG. 4). The inkjet head unit 48 is arranged above the belt conveyance unit 47. The inkjet head unit 48 discharges ink from the inkjet heads onto the sheets P which have been conveyed by the belt conveyance unit 47, to thereby print an image thereon.

At the time of bookbinding printing, the connecting unit 33 delivers the printed sheets P (text sheets P1 and cover sheet P2) to the bookbinding device 4. The connecting unit 33 includes a switching unit 49 and a connecting roller 50.

The switching unit 49 switches the conveyance path of the sheets P between the normal path RC and the connecting path RJ. The switching unit 49 is arranged at a branching point between the normal path RC and the connecting path RJ. The connecting path RJ is a path extending toward the bookbinding device 4 from the boundary between the printer 32 and the upper surface conveyance unit 34. The downstream end of the connecting path RJ is connected to the upstream end of an introduction path RI, described below, of the bookbinding device 4.

The connecting roller 50 conveys the sheets P which have been conveyed from the belt conveyance unit 47, and delivers them to the bookbinding device 4. The connecting roller 50 is arranged on the downstream side of the switching unit 49 along the connecting path RJ. The connecting roller 50 is driven by a motor not illustrated.

The upper surface conveyance unit 34 conveys, from the right to the left in a U-turn manner, the sheets P which have been conveyed by the belt conveyance unit 47. The upper surface conveyance unit 34 has a plurality of pairs of upper surface conveyance rollers 51.

The upper surface conveyance rollers 51 convey the sheets P, while nipping the sheets P. The upper surface conveyance roller 51 at the most downstream is arranged upstream of the reverse path RR. The other upper surface conveyance roller 51 is arranged along the normal path RC between the printer 32 and the paper discharger 35. The upper surface conveyance roller 51 is driven by a motor not illustrate).

The paper discharger 35 discharges the printed sheets P. The paper discharger 35 has a switching unit 52, a discharge roller 53, and a paper receiving tray 54.

The switching unit 52 switches the conveyance path of the sheets P between the paper discharge path RD and the reverse path RR. The switching unit 52 is arranged at a branching point between the paper discharge path RD and the reverse path RR.

The discharge roller 53 conveys the sheets P which have been conveyed by the upper surface conveyance unit 34, and discharges the sheets P onto the paper receiving tray 54. The discharge roller 53 is arranged between the switching unit 52 and the paper receiving tray 54 along the paper discharge path RD. The discharge roller 53 is driven by a motor not illustrated.

The paper receiving tray 54 is provided in order to stack the discharged sheets P. The paper receiving tray 54 is arranged at the downstream end of the paper discharge path RD.

When performing duplex printing, the reversing unit 36 reverses the sheets P subjected to simplex printing, and conveys the sheets to the resist roller 46. The reversing unit 36 has a reverse roller 55, a switchback unit 56, a paper refeed roller 57, and a switching gate 58.

After temporarily carrying in the sheets P which have been conveyed by the upper surface conveyance unit 34, into the switchback unit 56, the reverse roller 55 carries out the sheets P and conveys it to the paper refeed roller 57. The reverse roller 55 is arranged on the reverse path RR between the upper surface conveyance roller 51 at the most downstream and the carry-in entrance of the switchback unit 56. The reverse roller 55 is driven by a motor not illustrated.

The switchback unit 56 is a space for temporarily carrying in the sheets P by the reverse roller 55. The switchback unit 56 is formed at a lower part of the paper receiving tray 54. The switchback unit 56 is opened at the vicinity of the reverse roller 55 for carrying in the sheets P.

The paper refeed roller 57 conveys, to the resist roller 46, the sheets P which have been conveyed by the reverse roller 55. The paper refeed roller 57 is arranged on the reverse path RR between the reverse roller 55 and the resist roller 46. The paper refeed roller 57 is driven by a motor not illustrated.

The switching gate 58 guides, to the reverse roller 55, the sheets P which have been conveyed by the upper surface conveyance roller 51. In addition, the switching gate 58 guides, to the paper refeed roller 57, the sheets P taken out from the switchback unit 56 by the reverse roller 55. The switching gate 58 is arranged in the vicinity of the centroid of three positions: the upper surface conveyance roller 51, the reverse roller 55, and the paper refeed roller 57 at the most downstream side.

The environmental condition detector 37 detects the environmental conditions in the printing device 3. The environmental condition detector 37 has a temperature sensor 59 and a humidity sensor 60.

The temperature sensor 59 is installed in the vicinity of the paper feeder 31 within the housing 39. The temperature sensor 59 detects the temperature in the vicinity of the paper feeder 31, and outputs the detected result to the print control unit 38. Meanwhile, the place of installing the temperature sensor 59 can be changed as appropriate.

The humidity sensor 60 is installed in the vicinity of the paper feeder 31 within the housing 39. The humidity sensor 60 detects the humidity in the vicinity of the paper feeder 31, and outputs the detected result to the print control unit 38. Meanwhile, the place of installing the humidity sensor 60 can be changed as appropriate.

The print control unit 38 controls operation of each part of the printing device 3. The print control unit 38 includes a CPU, RAM, ROM, a hard disk, or the like.

The bookbinding device 4 binds a book by case binding of a sheet stack PS including a plurality of text sheets P1 printed in the printing device 3, with a cover sheet P2 printed in the printing device 3. In other words, bookbinding is performed by wrapping the sheet stack PS with the cover sheet P2. The bookbinding device 4 has a bound book conveyance unit 61, an alignment tray 62, a clamp unit 63, a cutting unit 64, an adhesive agent application unit 65, a formation unit 66, a guide member 67, a discharge unit 68, a bookbinding control unit 69, and a housing 70 for receiving or retaining each part.

Meanwhile, among the conveyance paths in the bookbinding device 4, the path indicated by the solid line is a vertical conveyance path RV, the path indicated by the dashed line is a text delivery path RH, the path indicated by the one-dot chain line is a cover sheet setting path RF, and the path indicated by the two-dot chain line is an introduction path RI.

The bound book conveyance unit 61 introduces the text sheets P1 and the cover sheet P2, printed in the printing device 3 and conveys them. The bound book conveyance unit 61 has an introduction roller 71, a plurality of pairs of upper rollers 72, a plurality of pairs of lower rollers 73, a switching unit 74, a delivery roller 75, a switching unit 76, a plurality of pairs of horizontal conveyance rollers 77, encoders 78 and 79, and sheet sensors 80 and 81.

The introduction roller 71 takes in the text sheets P1 and the cover sheet P2 from the connecting unit 33 of the printing device 3 and conveys them to the vertical conveyance path RV. The introduction roller 71 is arranged along the introduction path RI. The upstream end of the introduction path RI is connected to the downstream end of the connecting path RJ of the printing device 3. The introduction roller 71 is driven by a motor not illustrated.

The upper rollers 72 convey upward the text sheets P1 which have been conveyed thereto by the introduction roller 71. In addition, the upper rollers 72 convey upward the cover sheet P2 which has been conveyed by the introduction roller 71 in order to detect the length of the cover sheet P2, and convey the cover sheet P2 downward when the lower end of the cover sheet P2 passes the sheet sensor 80. The upper rollers 72 are arranged along the vertical conveyance path RV between the junction point of the introduction path RI and the vertical conveyance path RV, and the branching point between the vertical conveyance path RV and the text delivery path RH. The upper rollers 72 are driven by a motor not illustrated.

The lower rollers 73 convey the cover sheet P2 which has been conveyed by the upper rollers 72 to the cutting unit 64 located below, and returns the cut cover sheet P2 upward. The lower rollers 73 are arranged along the vertical conveyance path RV downstream of the branching point between the vertical conveyance path RV and the cover sheet setting path RF. The lower rollers 73 are driven by a motor not illustrated.

The switching unit 74 switches the conveyance path of the text sheets P1 from the vertical conveyance path RV to the text delivery path RH. The switching unit 74 is arranged at the branching point between the vertical conveyance path RV and the text delivery path RH.

The delivery roller 75 delivers, to the alignment tray 62, the text sheets P1 which have been conveyed by the upper rollers 72. The delivery roller 75 is arranged along the text delivery path RH. The delivery roller 75 is driven by a motor not illustrated.

The switching unit 76 switches the conveyance path of the cover sheet P2 between the vertical conveyance path RV and the cover sheet setting path RF. The switching unit 76 is arranged at the branching point between the vertical conveyance path RV and the cover sheet setting path RF.

The horizontal conveyance roller 77 conveys, to the formation unit 66, the already-cut cover sheet P2 which has been introduced to the cover sheet setting path RF by the switching unit 76. The horizontal conveyance roller 77 is arranged along the cover sheet setting path RF. The horizontal conveyance roller 77 is driven by a motor not illustrated.

The encoder 78 generates a pulse signal according to rotation of the upper rollers 72. The encoder 78 is installed on one of the upper rollers 72.

The encoder 79 generates a pulse signal according to rotation of the lower rollers 73. The encoder 79 is installed on one of the lower rollers 73.

The sheet sensors 80 and 81 detect the sheets P being conveyed along the vertical conveyance path RV. The sheet sensor 80 is arranged between the uppermost one of the upper rollers 72 and an adjacent one of the upper rollers 72 on the lower side thereof. The sheet sensor 80 is provided in order to detect the length of the cover sheet P2. The sheet sensor 81 is arranged in the vicinity of the lower rollers 73. The sheet sensor 81 is used for positioning the cover sheet P2 at the time of cutting.

The alignment tray 62 aligns the plurality of text sheets P1. The alignment tray 62 has a bottom 86 and a front end fence 87, a rear end fence 88, and a pair of side fences 89.

The bottom 86 is provided in order to stack the text sheets P1.

The front end fence 87 limits the position of the front end (downstream) in the conveyance direction of the text sheets P1 on the bottom 86. The front end fence 87 is configured to be movable in the sheet conveyance direction by the driving force of a motor not illustrated.

The rear end fence 88 limits the position of the rear end (upstream) in the conveyance direction of the text sheets P1 on the bottom 86. The rear end fence 88 is configured to be movable in the sheet conveyance direction by the driving force of a motor not illustrated.

The pair of side fences 89 limits the position of the direction perpendicular to the sheet conveyance direction of the text sheets P1 on the bottom 86 (forward and backward direction). The pair of side fences 89 is configured to be movable, in a direction perpendicular to the sheet conveyance direction (forward and backward direction, i.e., a direction substantially perpendicular to the vertical and horizontal directions in FIG. 4), so as to come close to, or move away from, each other by the driving force of a motor not illustrated.

The clamp unit 63 moves the sheet stack PS including the plurality of text sheets P1 stacked on the alignment tray 62 to a formation standby position. The clamp unit 63 includes a pair of clamp plates 91 and a sheet stack thickness sensor 92 (sheet stack thickness measurement unit).

The pair of clamp plates 91 clamps (sandwiches) the sheet stack PS stacked on the alignment tray 62. The pair of clamp plates 91 is opened or closed by the driving force of a motor not illustrated, and clamp or release the sheet stack PS. The pair of clamp plates 91 is configured to be movable, while clamping the sheet stack PS, by the driving force of a motor not illustrated. While waiting for the text sheets P1 equivalent of a single copy of book to be aligned by the alignment tray 62, the pair of clamp plates 91 is arranged at a clamp position indicated by the solid line in FIG. 4. When the text sheets P1 equivalent of a single copy of book are aligned by the alignment tray 62 and the sheet stack PS is clamped, the pair of clamp plates 91 moves to a formation standby position as indicated by the two-dot chain line in FIG. 4. In the formation standby position, the pair of clamp plates 91 retains the sheet stack PS so that the side surface PSb of the sheet stack PS is substantially in parallel with the vertical direction.

The sheet stack thickness sensor 92 measures the thickness of the sheet stack PS. The sheet stack thickness sensor 92 is installed on a clamp plate 91. When the pair of clamp plates 91 clamps the sheet stack PS, the sheet stack thickness sensor 92 measures the thickness of the sheet stack PS, based on the travel distance from the home position of the clamp plate 91. The sheet stack thickness sensor 92 outputs the measurement result to the bookbinding control unit 69. The home position of the pair of clamp plates 91 is detected by a sensor which is not illustrated.

The cutting unit 64 performs cutting for adjusting the length of the cover sheet P2. The cutting unit 64 is arranged at the lower end of the vertical conveyance path RV.

The adhesive agent application unit 65 applies hot-melt adhesive agent on the back side PSa of the sheet stack PS. The adhesive agent application unit 65 is arranged on the right-hand side of the formation unit 66. The adhesive agent application unit 65 includes a body or adhesive agent receiving unit 93 and an application roller 94.

The adhesive agent receiving unit 93 receives hot-melt adhesive agent G. The hot-melt adhesive agent G adheres the sheet stack PS and the cover sheet P2.

The application roller 94 causes the hot-melt adhesive agent G received in the adhesive agent receiving unit 93 to be adhered to the outer peripheral surface. The back side PSa of the sheet stack PS coming into contact with the application roller 94 causes the hot-melt adhesive agent G adhered to the outer peripheral surface of the application roller 94 to adhere to the back side PSa of the sheet stack PS.

The formation unit 66 folds the cover sheet P2 with the sheet stack PS abutting the cover sheet P2 to form a booklet PB. The formation unit 66 is arranged at the right bottom of the alignment tray 62. The formation unit 66 includes a pair of back folding plates 96 and an jogging plate 97.

The pair of back folding plates 96 is provided in order to fold the boundary region between the front cover and the spine, and the boundary between the spine and the back cover of the cover sheet P2. The pair of back folding plates 96 is configured to be movable in the horizontal direction in a manner coming close to, or moving away from, each other by the driving force of a motor not illustrated. The back folding plate 96 is arranged on the jogging plate 97.

The jogging plate 97 is provided in order to abut the back side PSa of the sheet stack PS via the cover sheet P2. The jogging plate 97 is arranged below the formation standby position. The jogging plate 97 is configured to be movable by the driving force of a motor not illustrated.

The guide member 67 guides the booklet PB which has fallen from the formation unit 66. The guide member 67 is arranged below the formation unit 66.

The discharge unit 68 discharges the booklet PB which has fallen on the formation unit 66 to the outside of the housing 70. The discharge unit 68 is arranged at a lower part of the housing 70. The discharge unit 68 includes a transportation conveyer 98 and a discharge conveyer 99.

The transportation conveyer 98 receives, conveys rightward, and drops onto the discharge conveyer 99, the booklet PB which has fallen on the formation unit 66. The transportation conveyer 98 is driven by a motor not illustrated.

The discharge conveyer 99 receives, conveys rightward, and discharges to a receiving tray outside the housing 70 not illustrated, the booklet PB which has fallen on transportation conveyer 98. The discharge conveyer 99 is driven by a motor not illustrated.

The bookbinding control unit 69 controls operation of each part of the bookbinding device 4. The bookbinding control unit 69 includes a CPU, RAM, ROM, a hard disk, or the like.

Next, operation of the bookbinding system 1 will be described.

First, the bookbinding printing operation in the printing device 3 will be described. Here, it is assumed that the text sheets P1 are stacked on each internal paper feed tray 43 and the cover sheets P2 are stacked on the external paper feed tray 41.

When the printing device 3 starts the bookbinding printing operation, the unprinted text sheets P1 which have been conveyed from the internal paper feed tray 43 along the paper feed path RS are fed to the printer 32. In the printer 32, the text sheets P1 are conveyed to the belt conveyance unit 47 by the resist roller 46. The text sheets P1, while being conveyed by the belt conveyance unit 47, are subjected to printing with ink discharged from the inkjet head unit 48.

In the case of simplex printing, the text sheets P1 which have been subjected to simplex printing are guided to the connecting path RJ by the switching unit 49 of the connecting unit 33, while being conveyed by the belt conveyance unit 47. Then, the text sheets P1 are delivered to the bookbinding device 4 by the connecting roller 50.

In the case of duplex printing, the text sheets P1 which have been subjected to simplex printing are guided to the upper surface conveyance unit 34 by the switching unit 49 of the connecting unit 33, while being conveyed by the belt conveyance unit 47. The text sheets P1 are conveyed by the upper surface conveyance roller 51 of the upper surface conveyance unit 34, and guided to the reverse path RR by the switching unit 52 of the paper discharger 35. The text sheets P1 guided to the reverse path RR are guided to the reverse roller 55 by the switching gate 58 in the reversing unit 36, and are carried in the switchback unit 56 by the reverse roller 55. Subsequently, the text sheets P1 are carried out from the switchback unit 56 by the reverse roller 55, and guided to the paper refeed roller 57 by the switching gate 58. Then, the text sheets P1 are refed to the printer 32 by the paper refeed roller 57. In the printer 32, the text sheets P1 are conveyed to the belt conveyance unit 47 by the resist roller 46. Here, the text sheets P1 are reversed by the reversing unit 36, and thus the unprinted side thereof is oriented to the inkjet head unit 48. While being conveyed by the belt conveyance unit 47, the text sheets P1 have their unprinted side subject to printing with ink discharged from the inkjet head unit 48. The text sheets P1 which have been subjected to duplex printing are delivered from the connecting unit 33 to the bookbinding device 4, as with the case of the simplex printing described above.

In the printing device 3, the plurality of text sheets P1 equivalent of a single copy of book are printed in sequence, and subsequently the cover sheet P2 is printed.

There may be a plurality of types of sheets included in the text sheets P1 equivalent of a single copy of book. In such a case, sheets are selectively fed from a plurality of internal paper feed trays 43 having stacked thereon different types of text sheets P1.

The cover sheet P2 is fed from the external paper feed tray 41 and is subjected to simplex or duplex printing, as with the case of the text sheets P1 described above. Then, the printed cover sheet P2 is delivered from the connecting unit 33 to the bookbinding device 4.

Next, the bookbinding operation in the bookbinding device 4 will be described.

After being introduced into the bookbinding device 4 by the introduction roller 71, the text sheets P1 printed in the printing device 3 are conveyed upward by the upper rollers 72. Then, the text sheets P1 are guided to the text delivery path RH by the switching unit 74, and are delivered to the alignment tray 62 by the delivery roller 75. When a number of text sheets P1 equivalent of a single copy of book are stacked on the alignment tray 62, the bookbinding control unit 69 closes the pair of clamp plates 91 at the clamp position to clamp the sheet stack PS. At this time, the bookbinding control unit 69 obtains the thickness of the sheet stack PS from the sheet stack thickness sensor 92.

Then, the bookbinding control unit 69 moves the pair of clamp plates 91 clamping the sheet stack PS to the formation standby position.

After being introduced into bookbinding device 4 by the introduction roller 71, the cover sheet P2 subjected to printing after the text sheets P1 is conveyed upward by the upper rollers 72. At this time, the cover sheet P2 is detected by the sheet sensor 80.

Here, the bookbinding control unit 69 obtains the length of the cover sheet P2 in the conveyance direction from the number of output pulses of the encoder 78 in an interval from when the front end of the cover sheet P2 being conveyed upward is detected to when the rear end thereof is detected. Then, the bookbinding control unit 69 obtains, as the cutting length of the cover sheet P2, a value obtained by subtracting, from the length of the cover sheet P2, a required length according to the sheet stack PS. The required length is a length obtained by adding the thickness of the sheet stack PS (thickness of the spine) to twice the short side length of the text sheets P1.

After the rear end of the cover sheet P2 is detected by the sheet sensor 80, the bookbinding control unit 69 drives the upper rollers 72 reversely. Subsequently, the cover sheet P2 is conveyed downward by the upper rollers 72 and the lower rollers 73.

The bookbinding control unit 69 stops the upper rollers 72 and the lower rollers 73 at the time when the front end (lower end) of the cover sheet P2 reaches a point downstream as far as the cutting length from the cutting position set for the cutting unit 64. Specifically, the bookbinding control unit 69 counts the number of output pulses of the encoder 79 from the moment when the sheet sensor 81 detects the front end (lower end) of the cover sheet P2. The bookbinding control unit 69 then stops the upper rollers 72 and the lower rollers 73 when the count value reaches a value corresponding to the distance with the cutting length added to the vertical interval between the sheet sensor 81 and the cutting position set for the cutting unit 64. The bookbinding control unit 69 then causes the cutting unit 64 to cut the cover sheet P2.

The cover sheet P2 which has been cut is conveyed upward by the upper rollers 72 and lower rollers 73. When the lower end of the cover sheet P2 passes the branching point between the vertical conveyance path RV and the cover sheet setting path RF, the cover sheet P2 has its conveyance direction reversed and is conveyed downward by the upper rollers 72. The cover sheet P2, after being guided to the cover sheet setting path RF by the switching unit 76, is conveyed by the horizontal conveyance roller 77 to be placed on the pair of back folding plates 96.

When the cover sheet P2 is placed on back folding plate 96, the bookbinding control unit 69 moves the pair of clamp plates 91 clamping the sheet stack PS from the formation standby position to above the adhesive agent application unit 65. The bookbinding control unit 69 then lowers the pair of clamp plates 91 to cause the back side (lower end side) PSa of the sheet stack PS to come in contact with the application roller 94. Accordingly, the hot-melt adhesive agent G adheres to the back side PSa of the sheet stack PS.

Subsequently, the bookbinding control unit 69 returns the pair of clamp plates 91 and the sheet stack PS to the formation standby position. The bookbinding control unit 69 lowers the pair of clamp plates 91 to cause the back side PSa of the sheet stack PS to abut the jogging plate 97 via the cover sheet P2.

Subsequently, the bookbinding control unit 69 moves the pair of back folding plates 96 so that they come closer to each other, and causes the pair of back folding plates 96 to press the lower end of the sheet stack PS from both the right and left side via the cover sheet P2. Accordingly, the boundary between the spine part and the front cover part of the cover sheet P2 to which the back side PSa of the sheet stack PS is abutting, and the boundary between the spine part and the back cover part are folded. As a result, the booklet PB is completed.

Subsequently, the bookbinding control unit 69 moves the pair of back folding plates 96 away from each other, and also shifts the jogging plate 97 leftward. Accordingly, the booklet PB falls from the formation unit 66.

The booklet PB which has fallen from the formation unit 66 lands on the transportation conveyer 98, while being guided by the guide member 67. The booklet PB is conveyed rightward by the transportation conveyer 98, and falls on the discharge conveyer 99. The booklet PB is then conveyed rightward by the discharge conveyer 99 and discharged to a receiving tray not illustrated outside the housing 70.

The bookbinding printing operation and the bookbinding operation described above are performed by transmitting, to the printing device 3, bookbinding print data generated in the information processor 2 according to the editing task by the user for bookbinding printing.

In the editing task for bookbinding printing in the information processor 2, the user specifies the types of sheets to be used as the text sheets P1 and the numbers of sheets of respective types, and performs the task of editing the image to be printed on each of the text sheets P1. Additionally, in the editing task for bookbinding printing, the user performs the task of editing the image to be printed on the cover sheet P2.

Figure 5:
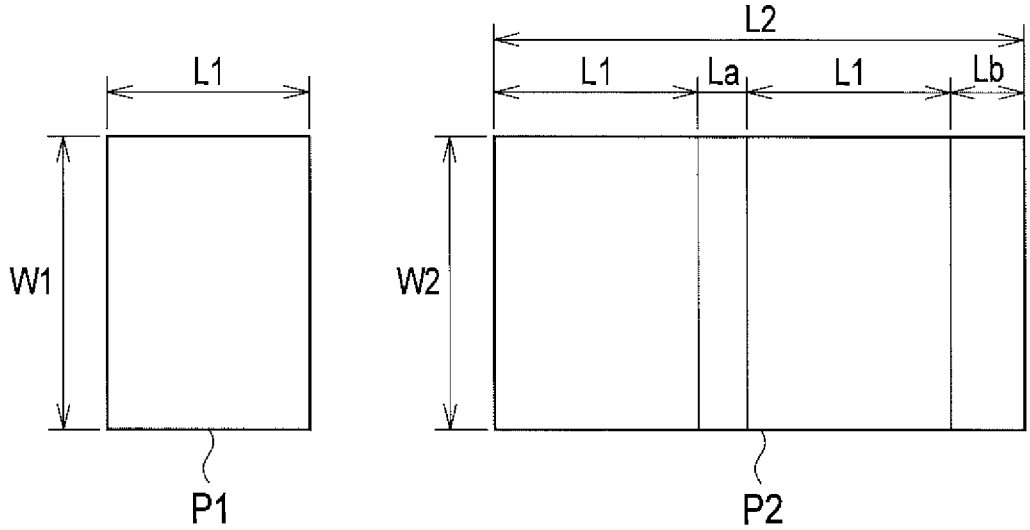
FIG. 5 is an explanatory diagram describing the relation of sizes of the text sheets and the cover sheet.

Now, the relation between the sizes of the text sheets P1 and the cover sheet P2 will be described. As illustrated in FIG. 5, the short side length of the text sheets P1 is denoted L1, the long side length of the text sheets P1 is denoted W1, the long side of the cover sheet P2 is denoted L2, and the short side length of the cover sheet P2 is denoted W2.

Since the long side length W1 of the text sheets P1 and the short side length W2 of the cover sheet P2 are the long side length of the booklet PB, the both are approximately the same. In order to perform case binding of the sheet stack PS of the text sheets P1 with the cover sheet P2, the long side length L2 of the cover sheet P2 is longer than twice the short side length L1 of the text sheets P1. In the bookbinding printing operation and bookbinding operation, the text sheets P1 are conveyed with their short side oriented in parallel with the conveyance direction, whereas the cover sheet P2 is conveyed with its long side oriented in parallel with the conveyance direction.

The required length of the cover sheet P2 is a length resulting from adding the thickness La of the thickness of the spine to twice the short side length of the text sheets P1. The length Lb is the cutting length that resulted from subtracting the required length (2×L1+La) from the long side length L2 of the cover sheet P2.

The thickness La of the spine corresponds to the thickness of the sheet stack PS. In the bookbinding operation, as described above, the thickness of the sheet stack PS is measured, the cutting length Lb is calculated using the measurement result, and cutting of the cover sheet P2 is performed.

In order to assure that the images on the front cover and the back cover of the finished booklet PB are printed at appropriate positions, it is necessary in the editing task to set the thickness La of the spine accurately. However, measurement of the thickness of the sheet stack PS during bookbinding operation is not yet performed at the stage of editing task in the information processor 2. Accordingly, the actual thickness of the sheet stack PS, i.e., the actual thickness La of the spine is unknown at the stage of editing task.

The thickness of the sheet stack PS can be predicted from the types of the text sheets P1 and the numbers of sheets of respective types. However, since the thickness of the text sheets P1 is influenced by the environmental condition, there is arises a concern that the prediction value may deviate from the actually measured value when environmental conditions are not taken into consideration.

Therefore, the bookbinding system 1 of the first embodiment, obtains a prediction value Lp of the thickness of the sheet stack PS according to the environmental condition, and presents the prediction value Lp to the user performing the editing task.

The process of obtaining the prediction value Lp will be described, referring to the flow chart of FIG. 6.

Figure 6:
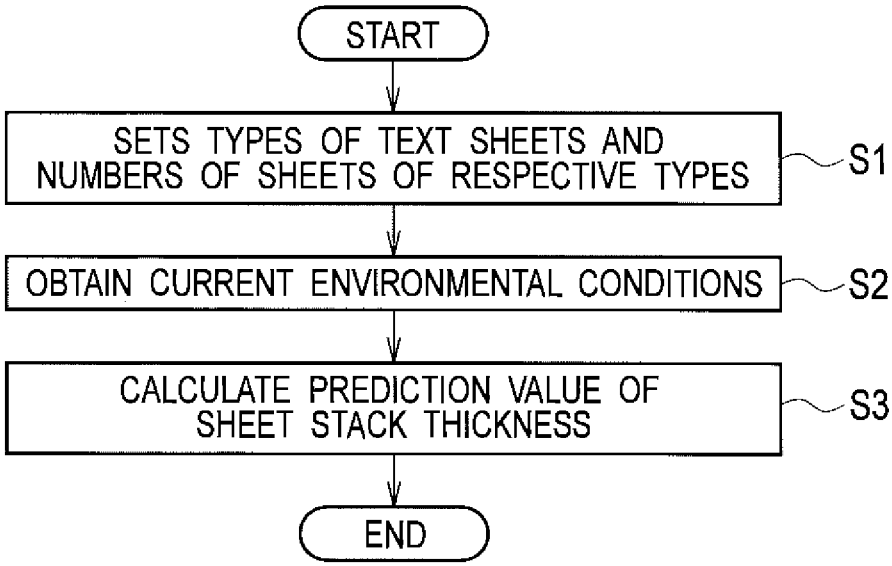
FIG. 6 is a flow chart of process of calculating a prediction value of the sheet stack thickness in the first embodiment.

When the editing task for bookbinding printing by the user is started in the information processor 2, the setting unit 21 of the bookbinding application unit 11 sets, at Step S1 of FIG. 6, the types of sheets used as the text sheets P1 and the numbers of sheets of respective types according to the user operation.

Subsequently, at Step S2, the sheet stack thickness prediction unit 22 obtains current environmental conditions from the printing device 3. Specifically, the sheet stack thickness prediction unit 22 obtains (obtains the environmental condition), from the print control unit 38, information of the current temperature in the vicinity of the paper feeder 31 detected by the temperature sensor 59 of the printing device 3, and information of the current humidity in the vicinity of the paper feeder 31 detected by the humidity sensor 60.

Subsequently, at Step S3, the sheet stack thickness prediction unit 22 calculates the prediction value Lp of the thickness of the sheet stack PS containing text sheets P1 to be bound. Specifically, the sheet stack thickness prediction unit 22 obtains, from the sheet thickness table 25, sheet thickness according to current environmental conditions of each sheet type. The sheet stack thickness prediction unit 22 then calculates, for each sheet type, a value resulting from multiplying the set number of sheets by the sheet thickness, and calculates the total of the values for respective sheet types as the prediction value Lp.

Here, if there exists, in the set sheet type, a sheet type whose sheet thickness according to current environmental conditions is not stored in the sheet thickness table 25 and thus the thickness is unknown, the sheet stack thickness prediction unit 22 calculates the sheet thickness of the sheet type by interpolating another value stored in the sheet thickness table 25. For example, it is assumed that current environmental conditions correspond to a temperature between T3 and T4 and a humidity between H3 and H4, and sheet thickness of a certain sheet type under this environmental condition is not stored in the sheet thickness table 25. It is then assumed that sheet thickness of the sheet type for a temperature between T1 and T2 and a humidity between H3 and H4, and sheet thickness for a temperature between T5 and T6 and a humidity between H3 and H4 are stored in the sheet thickness table 25. In this case, the sheet stack thickness prediction unit 22 calculates sheet thickness of the sheet of this type under current environmental conditions, i.e., a temperature between T3 and T4 and a humidity between H3 and H4 by interpolation using sheet thickness of the sheet type for a temperature between T1 and T2 and a humidity between H3 and H4, and sheet thickness for a temperature between T5 and T6 and a humidity between H3 and H4.

The sheet stack thickness prediction unit 22 then calculates the prediction value Lp of the thickness of the sheet stack PS using the sheet thickness, calculated by interpolation, of the sheet type whose thickness is unknown.

Figure 7:
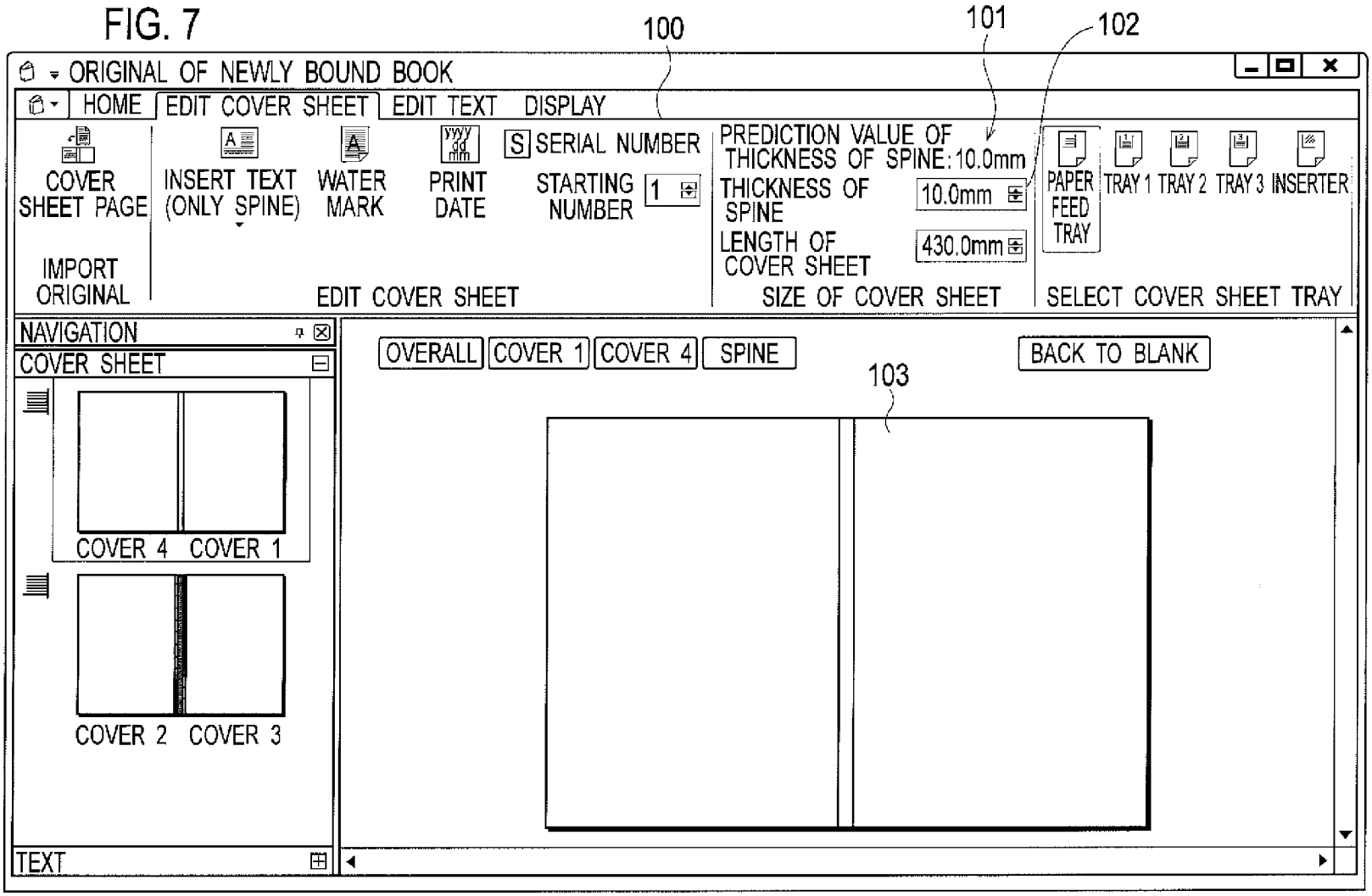
FIG. 7 illustrates a cover editing screen.

When the prediction value Lp of the thickness of the sheet stack PS is obtained by process of the flow chart of FIG. 6, the sheet stack thickness prediction unit 22 presents the prediction value Lp to the user. Specifically, the sheet stack thickness prediction unit 22 displays, on a spine thickness prediction value display field 101 of a cover editing screen 100 illustrated in FIG. 7, the prediction value Lp of the thickness of the sheet stack PS as the prediction value of the thickness La of the spine. Here, the thickness La of the spine corresponds to the thickness of the sheet stack PS as described above.

In addition, the sheet stack thickness prediction unit 22 also displays the prediction value Lp of the thickness of the sheet stack PS on a spine thickness input field 102 of the cover editing screen 100. The input value of the spine thickness input field 102 of the cover editing screen 100 becomes the setting value of the thickness La of the spine. The user can set the value of the prediction value Lp of the thickness of the sheet stack PS as the prediction value of the thickness La of the spine by setting the input value of the spine thickness input field 102 identical to the value displayed on the spine thickness prediction value indication field 101. The user can also change the input value of the spine thickness input field 102.

The cover editing screen 100 has a cover print image 103 displayed thereon. The user performs the task of editing the cover print image 103 to be printed on the cover sheet P2.

When the user finishes the editing task and performs an operation that instructs start of bookbinding printing, the printer driver 13 generates bookbinding print data and outputs it to the printing device 3. Accordingly, the bookbinding printing operation and the bookbinding operation described above are performed in the printing device 3 and the bookbinding device 4.

In the bookbinding operation, the thickness of the sheet stack PS is measured by the sheet stack thickness sensor 92 as described above. The sheet thickness calculation unit 23 of the bookbinding application unit 11 obtains the measured value of the thickness the sheet stack PS from the bookbinding device 4 via the printing device 3. In addition, the sheet thickness calculation unit 23 obtains the environmental condition at the time of measurement from the printing device 3. The sheet thickness calculation unit 23 then adds the measured thickness of the sheet stack PS to the measurement history information of the storage unit 12, in association with the numbers of sheets of respective types in the sheet stack PS and the environmental condition at the time of measurement.

Having performed the bookbinding operation and added the obtained value of the thickness of the sheet stack PS to the measurement history information, the sheet thickness calculation unit 23 determines whether or not sheet thickness which is not yet stored in the sheet thickness table 25 is calculable from the measurement history information.

For example, is it assumed that sheet thickness of ordinary paper for a temperature between T1 and T2 and a humidity between H3 and H4, and a sheet thickness of thin paper are not yet stored in the sheet thickness table 25. It is then assumed that thickness of a sheet stack including 15 sheets of ordinary papers and 15 sheets of thin papers for a temperature between T1 and T2 and a humidity between H3 and H4 had been measured in the past bookbinding operation, and that the measured sheet stack thickness Lsa is included in the measurement history information of the storage unit 12. It is further assumed that thickness of a sheet stack including 15 sheets of ordinary papers and 10 sheets of thin papers has been measured in the current bookbinding operation, and that the sheet stack thickness Lsb has been added to the measurement history information. In this case, the following equations (EQ1) and (EQ2) hold for sheet thickness X of ordinary paper and sheet thickness Y of thin paper.

$$15X+15\times Y=\mathrm{Lsa} \qquad \text{Equation (EQ1)}$$

$$15\times X+10\times Y=\mathrm{Lsb} \qquad \text{Equation (EQ2)}$$

Equations (EQ1) and (EQ2) can be regarded as simultaneous equations about the sheet thickness X of ordinary paper and the sheet thickness Y of thin paper. Therefore, the sheet thickness X of ordinary paper and the sheet thickness Y of thin paper in the above-mentioned environmental condition are calculable by solving these equations.

Therefore, the sheet thickness calculation unit 23 determines that the sheet thickness X of ordinary paper and the sheet thickness Y of thin paper in the above-mentioned environmental condition are calculable, and calculates their values from the equations (EQ1) and (EQ2). The sheet thickness calculation unit 23 then adds the calculated value to the sheet thickness table 25, in association with environmental conditions.

Here, it is assumed that the sheet thickness table 25 does not have stored therein a value of the sheet thickness in the initial state of the bookbinding system 1. As the bookbinding operation proceeds and the measurement history information is accumulated, the value of the thickness of each type of sheet for each environmental condition are supposed to be added to the sheet thickness table 25 by the sheet thickness calculation unit 23 as described above. The bookbinding system 1 has stored therein a default value of the sheet thickness of each type of sheet. At a stage where no value of the sheet thickness exists in the sheet thickness table 25, or in a case where the sheet thickness is not calculable even if the above-mentioned interpolation is used, the sheet stack thickness prediction unit 22 calculates the prediction value Lp of the thickness of the sheet stack PS using the default value as the sheet thickness of each type of sheet.

Next, an examination task of the value of the sheet thickness table 25 will be described.

When the thickness of the sheet stack PS is measured in the bookbinding operation, the sheet thickness calculation unit 23 compares the prediction value Lp of the thickness of the sheet stack PS calculated by the sheet stack thickness prediction unit 22 using the value of the sheet thickness table 25 before the bookbinding operation, and the value measured by the sheet stack thickness sensor (actual measurement value). When the difference between the actual measurement value and the prediction value Lp is equal to or larger than a threshold value, the sheet thickness calculation unit 23 specifies for examination the value in the sheet thickness table 25 used for calculation of the prediction value Lp. The sheet thickness calculation unit 23 then examines the value specified for examination in the sheet thickness table 25, using the value of the thickness of the sheet stack PS measured in subsequent bookbinding operations.

For example, in a certain environmental condition, it is assumed that the different of the prediction value Lp of the thickness of the sheet stack PS including ordinary paper and thick paper calculated using the value in the sheet thickness table 25 from the actual measurement value is equal to or larger than the threshold value. In this case, the sheet thickness calculation unit 23 is intended to confirm the value of the thickness of ordinary paper and the value of the thickness of thick paper in the environmental condition. When the bookbinding operation using ordinary paper and thick paper with different combinations of number of sheets under the same environmental condition is subsequently performed twice (as many as the number of sheet types), the sheet thickness calculation unit 23 then calculates, from the actual measurement value of the thickness of the sheet stack PS at the time of the bookbinding operation thereof, sheet thickness X of ordinary paper and sheet thickness Z of thick paper as the value for confirmation. For example, upon obtaining, in subsequent bookbinding operations, the actual measurement value Lc1 of the thickness of the sheet stack including 10 sheets of ordinary papers and 15 sheets of thick papers, and the actual measurement value Lc2 of the thickness of the sheet stack including 10 sheets of ordinary papers and 20 sheets of thick papers, the sheet thickness calculation unit 23 regards the following equations (EQ3) and (EQ4) as simultaneous equations about X and Z, and calculates the values of X and Z.

$$10\times X+15\times Z=\mathrm{Lc1} \qquad \text{Equation (EQ3)}$$

$$10\times X+20\times Z=\mathrm{Lc2} \qquad \text{Equation (EQ4)}$$

The sheet thickness calculation unit 23 then compares the sheet thickness X of ordinary paper and the sheet thickness Z of thick paper calculated for examination as described above with the corresponding value in the sheet thickness table 25. If, as the result of comparison, there exists an error between the value for examination and the value in the sheet thickness table 25 which is equal to or larger than the threshold value, the sheet thickness calculation unit 23 updates the value in the sheet thickness table 25 with the value for examination.

As has been described above, the bookbinding system 1 calculates the prediction value Lp of the thickness of the sheet stack PS, based on the sheet thickness according to the environmental conditions detected by the environmental condition detector 37 for respective sheet types of the set text sheets P1 and the set numbers of sheets of respective types. Accordingly, the bookbinding system 1 can obtain the prediction value Lp of the thickness of the sheet stack PS according to current environmental conditions, and thus can enhance the prediction accuracy of the thickness of the sheet stack PS.

In addition, the bookbinding system 1, being provided with the sheet thickness table 25, can easily obtain the sheet thickness according to the environmental condition and calculate the prediction value Lp.

In addition, the bookbinding system 1 calculates, using the measurement history information, sheet thickness which is not yet stored in the sheet thickness table 25 as the sheet thickness corresponding to the environmental condition and the sheet type, and adds the calculated sheet thickness to the sheet thickness table 25. Accordingly, the bookbinding system 1 makes it possible to obtain an unknown sheet thickness by using the actual measurement value of the thickness of the sheet stack during bookbinding operation and to make use of calculation of a subsequent prediction value Lp.

Meanwhile, in the present embodiment, although it is assumed in an initial state of the bookbinding system 1 that the sheet thickness table 25 does not have stored therein values of the sheet thickness, a sheet thickness according to each environmental condition preliminarily measured for each sheet type may have been preliminarily stored in the sheet thickness table 25.

In addition, although the bookbinding system 1 stored the sheet thickness table 25 in the information processor 2, the sheet thickness table 25 may be stored in the printing device 3. The same applies to the measurement history information. In addition, the processing of calculating the prediction value Lp of the thickness of the sheet stack PS may be performed by the printing device 3.

Second Embodiment

Figure 8:
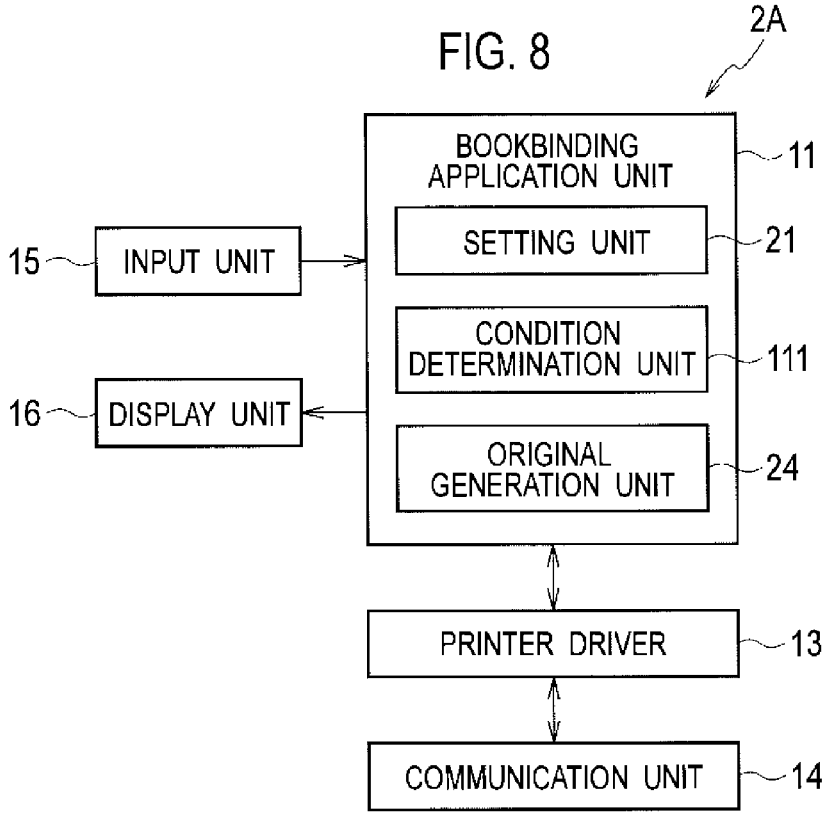
FIG. 8 is a block diagram illustrating a configuration of an information processor in a second embodiment.

FIG. 8 is a block diagram illustrating a configuration of an information processor in a second embodiment.

As illustrated in FIG. 8, the information processor 2A in the second embodiment, unlike the information processor 2 illustrated in FIG. 2, includes a condition determination unit 111 in the bookbinding application unit 11, while omitting the sheet stack thickness prediction unit 22, the sheet thickness calculation unit 23, and the storage unit 12 of the bookbinding application unit 11.

The condition determination unit 111 determines, on the basis of the setting of the bookbinding printing conditions, whether or not the size condition for the text sheets P1 and the cover sheet P2 is satisfied. The size condition includes the following equations (EQ 5) and (EQ6).

$$L1\times 2+La\leq L2 \qquad \text{Equation (EQ5)}$$

$$W1=W2 \qquad \text{Equation (EQ6)}$$

When the equation (EQ5) is not satisfied, the long side length L2, of the cover sheet P2, for wrapping the text sheets P1 is insufficient. When the equation (EQ6) is not satisfied, the short side length W2 of the cover sheet P2 is either too long or too short relative to the long side length W1 of the text sheets P1.

Performing case binding when at least one of the equation (EQ5) and equation (EQ6) is not satisfied may produce a defective item.

Therefore, when the size condition is not satisfied, in other words, when at least one of the equation (EQ5) and the equation (EQ6) is not satisfied, the condition determination unit 111 causes the display unit 16 to display a warning and prompts the user to change the input value.

Next, a process of resetting the thickness of the spine will be described.

There may be a case where, in the editing task, the user increases the number of text sheets P1 after setting the thickness La of the spine and editing the image for text sheets equivalent of the set number of sheets. In this case, it is necessary to reset the thickness of the spine.

Figure 9:
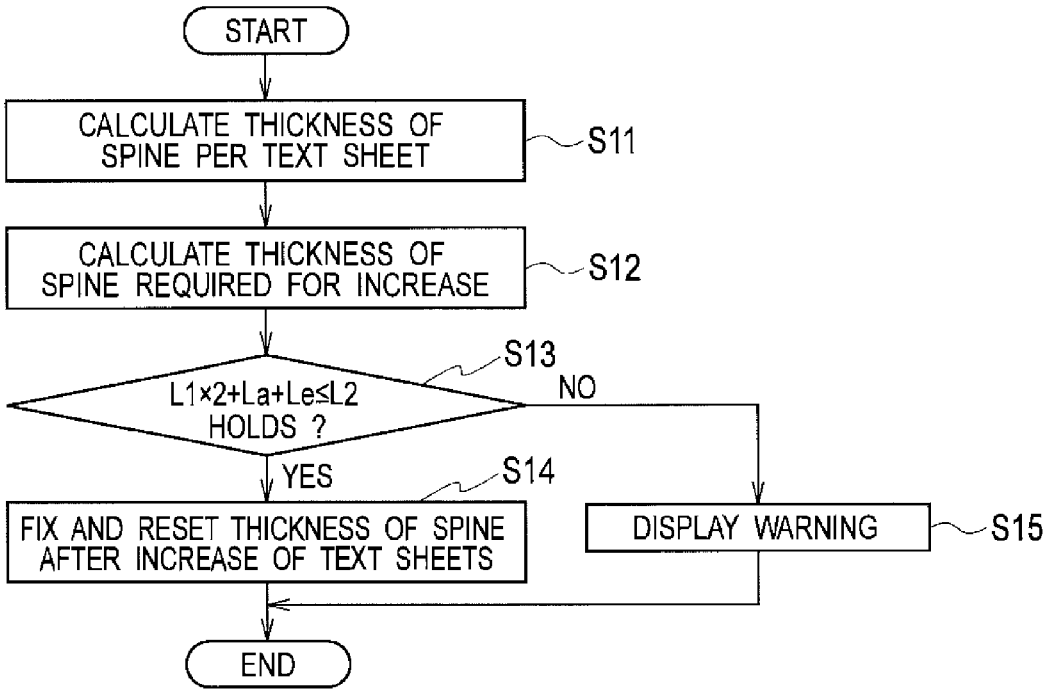
FIG. 9 is a flow chart of a re-setting process of the thickness of the spine in the second embodiment.

FIG. 9 is a flow chart of the process of resetting the thickness of the spine.

When an instruction to increase the number of text sheets P1 is provided by the user's operation, the condition determination unit 111 calculates, at Step S11 of FIG. 9, the thickness Ld of the spine per text sheet. The thickness Ld of the spine per text sheet is calculated by the following equations (EQ7) when the number of text sheets P1 before the increase is set to M.

$$Ld=La/M \qquad \text{Equation (EQ7)}$$

Subsequently, at Step S12, the condition determination unit 111 calculates a thickness Le of the spine required for the increase. The required thickness Le of the spine is calculated by the following equation (EQ8) when the number of text sheets P1 to be increased is set to Ma.

$$Le=Ld\times Ma \qquad \text{Equation (EQ8)}$$

Subsequently, at Step S13, the condition determination unit 111 determines whether or not the following equation (EQ9) is satisfied.

$$L1\times 2+La+Le\leq L2 \qquad \text{Equation (EQ9)}$$

The above equation (EQ9) has replaced La in the equation (EQ5) by the thickness "La+Le" of the spine after the increase of text sheets.

When the condition determination unit 111 has determined that the equation (EQ9) is satisfied (YES in Step S13), the setting unit 21 resets, at Step S14, the thickness of the spine after the increase of text sheets, to the fixed value of "La+Le".

When it has been determined that the equation (EQ9) is not satisfied (No in Step S13), the condition determination unit 111 causes the display unit 16 to display a warning at Step S15. Specifically, the condition determination unit 111 causes the display unit 16 to display shortage of the long side length of the cover sheet P2, and also displays contents prompting the user to carry out change of the text sheets P1, carry out change of the number of text sheets P1 to be increased, carry out change of the type of text sheets P1, or the like.

As has been described above, according to the second embodiment, the thickness of the spine of the cover sheet P2 can be reset without a user's efforts when increasing the number of text sheets P1.

Although embodiments of the present invention have been described above, the embodiments are only illustrative and are provided in order to facilitate understanding of the present invention, and the present invention is not a limited to the embodiments. The technical scope of the present invention is not limited to the specific technical articles disclosed in the embodiments described above and is intended to include a variety of variations, modifications, substitute techniques or the like which may be easily deduced therefrom.

The present application claims priority based on Japanese Patent Application No. 2013-032950 filed on Feb. 22, 2013, the entire contents of which are incorporated by reference herein.

Industrial Applicability

With the bookbinding system according to the present invention, the sheet stack thickness prediction unit calculates the prediction value of the sheet stack thickness, based on the sheet thickness according to the environmental condition detected by the environmental condition detector and the numbers of sheets of respective types set by the setting unit of respective types of text sheets set by the setting unit. Accordingly, the prediction value of the sheet stack thickness according to current environmental conditions can be obtained, and thus the prediction accuracy of the sheet stack thickness can be enhanced.

What is claimed is:

1. A bookbinding system comprising:

a printing device which performs printing on text sheets and a cover sheet;

a bookbinding device which binds a book by case binding, with the cover sheet printed by the printing device, of a sheet stack including the text sheets printed by the printing device; and an information processor which outputs a bookbinding print data to the printing device, a text sheet retainer which is provided in the printing device and retains one or more types of the text sheets;

an environmental condition detector which is provided in the printing device and detects environmental conditions in the printing device;

a setting unit which sets the types of the text sheets to be bound and a number of each of the types of the text sheets; and a sheet stack thickness prediction unit which calculates a prediction value of a sheet stack thickness including the text sheets to be bound, based on a sheet thickness according to the environmental conditions detected by the environmental condition detector, for each of the types of the text sheets set by the setting unit, and the number of the text sheets of each type set by the setting unit.

2. The bookbinding system according to claim 1, further comprising:

a sheet thickness table which stores a sheet thickness of each type of the text sheets retained by the text sheet retainer in association with the environmental conditions, wherein the sheet stack thickness prediction unit obtains, from the sheet thickness table, the sheet thickness according to the environmental conditions detected by the environmental condition detector, for each type of the text sheets set by the setting unit, and calculates a prediction value by using an obtained sheet thickness of each type of the text sheets.

3. The bookbinding system according to claim 2, further comprising:

a sheet stack thickness measuring unit which is provided in the bookbinding device and measures the sheet stack thickness including the text sheets;

a storage unit which stores, as a measurement history information, the sheet stack thickness measured by the sheet stack thickness measuring unit during bookbinding operation, in association with the number of each type of the text sheets in each of the sheet stacks and the environmental conditions at a time of measurement; and a sheet thickness calculation unit which calculates, by using the measurement history information, the sheet thickness which is not yet stored in the sheet thickness table as the sheet thickness corresponding to the environmental conditions and the types of the text sheets, and which adds the calculated sheet thickness to the sheet thickness table.

* * * * *